United States Patent [19]

Peterson

[11] Patent Number: 5,035,607

[45] Date of Patent: Jul. 30, 1991

[54] FUEL BURNER HAVING AN INTERMITTENT PILOT WITH PRE-IGNITION TESTING

[75] Inventor: Scott M. Peterson, Eden Praire, Minn.

[73] Assignee: Honeywell Inc., Minneapolis, Minn.

[21] Appl. No.: 600,801

[22] Filed: Oct. 22, 1990

[51] Int. Cl.[5] ..... F23Q 9/08

[52] U.S. Cl. ..... 431/46; 431/24; 431/66

[58] Field of Search ..... 431/46, 45, 24, 66

[56] References Cited

U.S. PATENT DOCUMENTS

| | | | |
|---|---|---|---|
| 3,282,324 | 11/1966 | Romanelli | 158/126 |
| 3,676,042 | 7/1972 | Osborne | 431/66 |
| 4,078,879 | 3/1978 | Dietz | 431/51 |
| 4,190,414 | 2/1980 | Elmy | 432/46 |
| 4,298,335 | 11/1981 | Riordan et al. | 431/45 |
| 4,323,342 | 4/1982 | Sommers, Jr. et al. | 431/66 |
| 4,360,338 | 11/1982 | Katchka | 431/46 |
| 4,560,343 | 12/1985 | Bohan, Jr. | 431/66 |
| 4,746,284 | 5/1988 | Geary | 431/70 |

*Primary Examiner*—Carroll B. Dority

*Attorney, Agent, or Firm*—Edward Schwarz

[57] ABSTRACT

A fuel burner includes an electrical igniter which lights a pilot burner which then lights the main burner. Operation of each of these steps is monitored, and if any are improper, the control device reverts to lighting the pilot burner with the main burner valve shut. If the igniter is sensed as incapable of lighting the pilot burner, the pilot burner valve is shut, and an error is indicated to the operator.

5 Claims, 2 Drawing Sheets

FUEL BURNER HAVING AN INTERMITTENT PILOT WITH PRE-IGNITION TESTING

BACKGROUND OF THE INVENTION

In current fuel burner designs, energy efficiency is a major consideration. One obvious way to reduce fuel consumption by a burner is to use other than a standing (constantly burning) pilot flame for ignition. There are two major types of non-pilot ignition sources, spark igniters and hot surface igniters. Both of these can be used directly to light a furnace. However, there are certain problems that arise with either of these types of igniters when direct ignition is used since they tend to fail more frequently than does pilot ignition. If direct ignition does not occur promptly once it is attempted, then it is necessary to shut off the flow of fuel and purge the furnace before attempting another lighting to prevent ignition with an unsafe amount of fuel within the combustion chamber. Neither is it satisfactory to reduce flow of fuel during direct ignition since this usually increases the difficulty of lighting the burner. Controls to implement direct ignition of furnaces are relatively complex because of this problem, and hence become expensive.

Because of these problems, many furnaces, particularly larger ones, now use an intermittent pilot burner which is lit each time there is a demand for heat from the fuel burner. Once such an intermittent pilot burner has been lit successfully, then it is used to light the main burner. Intermittent pilot flames are now usually lit by a spark igniter which is activated after the pilot burner valve has been opened. The ignition control holds open the pilot burner valve for a set period of time, and if the pilot flame is not sensed by the end of that time period, locks the system out. Ignition failure for the pilot light requires manual resetting of an interlock before further ignition attempts can occur. The time period allowed for setting the pilot flame is short enough to prevent a dangerous escape of gas and long enough to assure that the pilot flame will usually set if there is any chance that it will.

As mentioned, it is the usual practice to light these intermittent pilots with a spark igniter. However, there is no reason that a hot surface igniter cannot be used for igniting an intermittent pilot. Such an igniter typically comprises a short piece of conductive silicon carbide or other conductive refractory material placed in proximity to the fuel jets and through which is passed a current of sufficient magnitude to cause it to be heated to a temperature of at least 1000° C.

Even more important than energy efficiency is safety in the operation of fuel burners. If flame is not present whenever either the main or pilot valve is open, fuel can accumulate in the burner chamber, creating a potentially dangerous condition. Obviously, there is a much greater potential for harm if the main valve is open without a flame being present simply because of the much greater amount of fuel which the main valve passes. In general a pilot valve can be open for some time before a dangerous situation is created, and by timing out the pilot valve lighting procedure, little risk arises.

It has been standard practice to provide some sort of flame sensor so as to assure that flame is present whenever a fuel valve is open. The reason for sensing flame when the main valve is open, is manifest. The reason for sensing the presence of the pilot flame is as a necessary condition for opening the main valve, to thereby assure that ignition of the fuel flowing through the main valve will occur. Typically flame is sensed by either some kind of heat sensor, by the ability of the flame to rectify an AC current, or by a photoelectric device which senses the radiation generated by the flame.

There are a number of patent references which pertain to the technology of safe and efficient management of burners which are lit by intermittent pilots. U.S. Pat. No. 4,360,338 (Katchka) tests only the pilot flame to be present before opening the main valve. U.S. Pat. No. 4,689,006 (Gann) discloses a spark igniter for an intermittent pilot where a single pole double throw relay is controlled by the pilot flame sensor to switch power from the igniter to the main valve. U.S. Pat. No. 4,565,520 (Gann) discloses main burner ignition conditioned on pilot ignition, with a limited trial ignition period for pilot ignition.

BRIEF DESCRIPTION OF THE INVENTION

It is possible to increase the safety and efficiency of the operation of such burner systems having a main burner and an intermittent pilot burner by conditioning operation of the pilot burner valve on the acceptable functioning of igniter. It is extremely easy to determine acceptable functioning of a hot surface igniter by comparing the power which the igniter draws when activated, with a predetermined value. Opening of the pilot burner valve which controls flow of fuel to the pilot burner is responsive to a pilot valve control signal. The control system for the fuel burner includes an igniter sensing means in sensing relation to the igniter for providing an igniter signal responsive to operation of the igniter. A pilot valve control means receives the igniter signal and provides the pilot valve control signal which controls the pilot burner valve responsive to the igniter signal. If the igniter is a hot surface igniter, the igniter signal is conditioned on either or both of the voltage across the igniter element being within a predetermined voltage range or on current flow through the igniter being within a predetermined current range.

Accordingly, one purpose of this invention is to prevent the pilot valve from being turned on until the igniter has been checked for proper operation.

Another purpose of this invention is to avoid nuisance lockouts arising from timing out during pilot light ignition.

Yet another purpose is to avoid the need for an ignition timer, thereby simplifying the burner control system.

DESCRIPTION OF THE PREFERRED EMBODIMENTS

Figure 1:
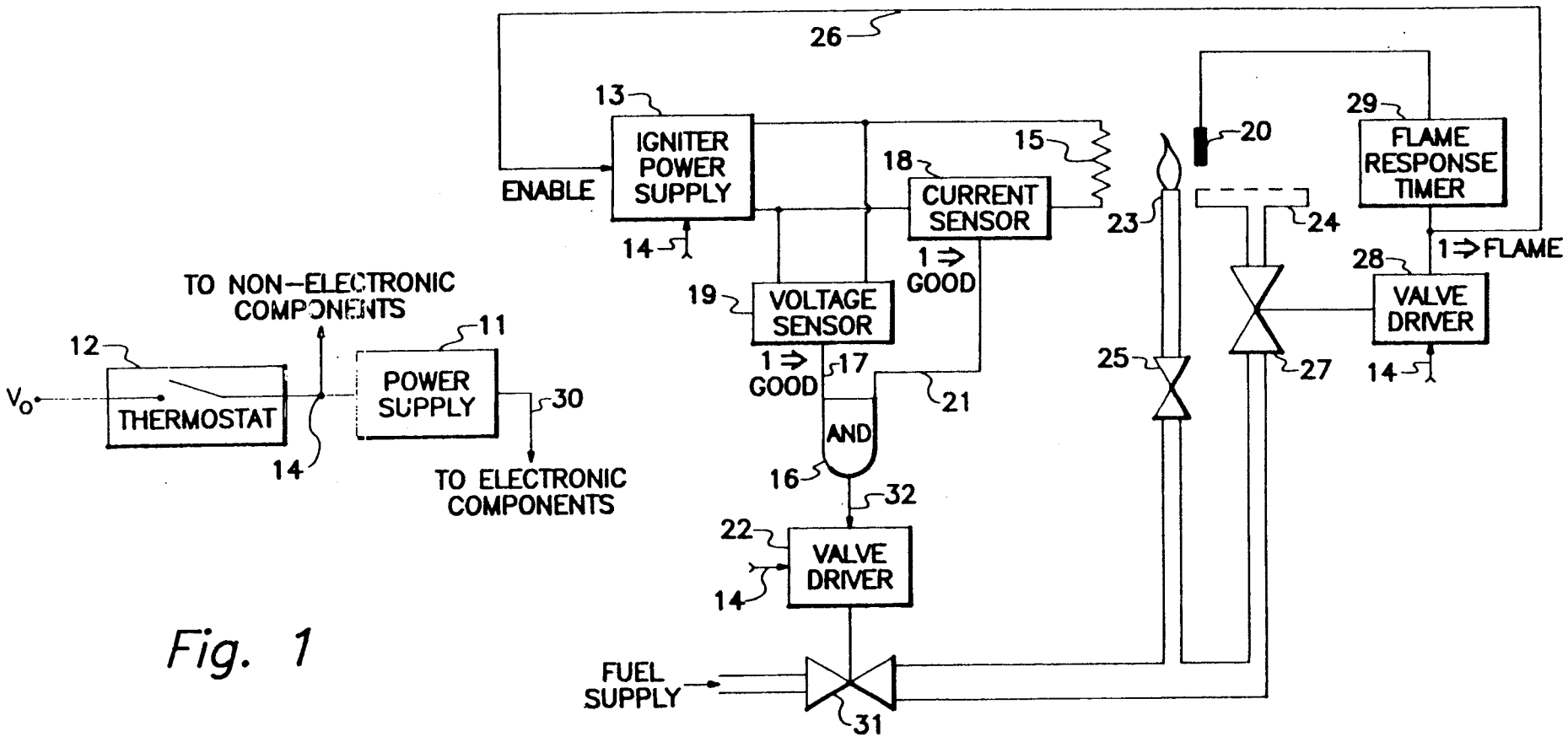
FIG. 1 is a simplified control circuit implementing the invention.
Figure 2:
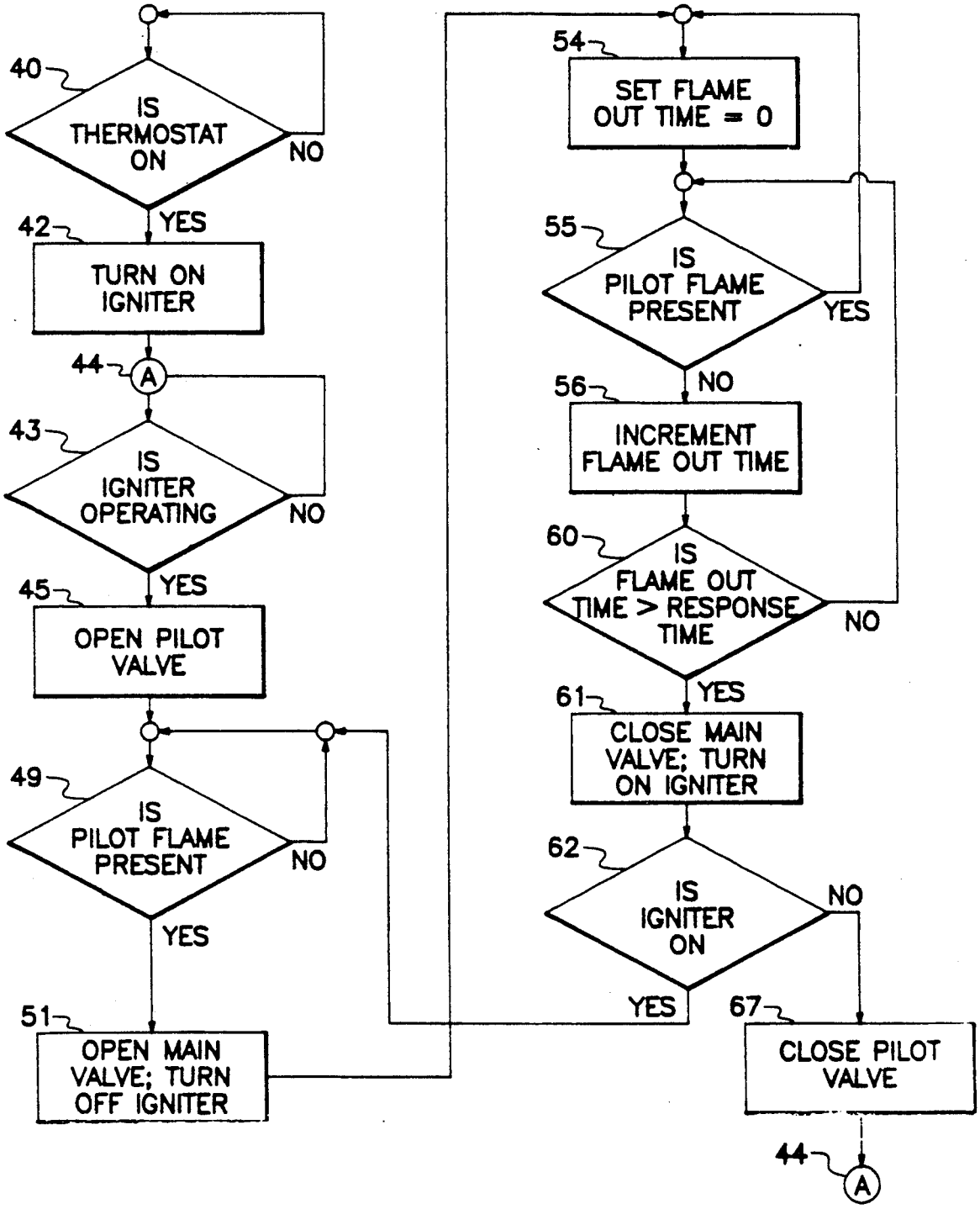
FIG. 2 is a flow diagram showing the sequence of operations of the invention, and on which may be based the part of a program for a microprocessor which implements the invention.

There are two different aspects of this invention. One comprises actual hardware and is shown in FIG. 1. It is also possible to accomplish the same control functions by use of a microprocessor which is programmed to direct execution of these functions, and FIG. 2 depicts a flow diagram or chart which can form the logical structure for suitable instructions implementing the invention. As a matter of currently accepted engineering practice, the two types of embodiments are understood to be completely equivalent, although there are features shown in FIG. 2 which are not provided by the simplified hardware implementation of FIG. 1.

Turning first to FIG. 1, the hardware implementation shown therein has a conventional thermostat 12 which switches a control voltage $V_O$ (24 VAC is standard) to provide when closed a demand signal on path 14. The control voltage $V_O$ also typically serves to supply the power for operating the control system of which the elements of this invention form a part. The electromechanical and other non-logic components typically use the control voltage $V_O$ on path 14 directly as is symbolized in FIG. 1, with path 14 shown as connected to various of these components such as igniter power supply 14 and valve drivers 22 and 28. A power supply 11 receives the demand signal/control voltage and supplies DC voltage on a power bus 30 for powering the logic and other electronic components.

When the demand signal voltage is applied on path 14, power is applied to the various components, and in particular the igniter power supply 13. The igniter power supply 13 provides power directly to an igniter 15 whenever enabled by a flame signal supplied by a flame response timer 29. For convenience, one may consider the power supply 13 here to interpret a logical 0 value for the flame signal on path 26 as implying absence of a flame, and a logical 1 value as implying presence of a flame. Thus, power supply 13 provides power to igniter 15 when a logical 0, implying no flame, is encoded in the flame signal. The igniter 15 is placed adjacent to a pilot burner 23 so that when fuel is supplied to the burner 23 and the igniter 15 is receiving the proper power from supply 13, the pilot flame will be lit.

Operation of the igniter 15 is monitored by a voltage sensor 19 and a current sensor 18. Voltage across the igniter 15 and the igniter power supply 13 is monitored by a voltage sensor 18. Both voltage sensor 19 and current sensor 18 are of the type which provide a logic level signal on path 17 or 21 respectively. Each of these sensor output signals is suitable to function as a logical or Boolean input to an AND gate 16. When voltage across or current flow from power supply 13 is within a predetermined voltage or current range it can be inferred that igniter 15 and its power supply 13 are both operating properly. To indicate this, the output from the sensor involved is a logical 1. If no or too low a voltage is present at the output of power supply 13, then it is likely that the power supply is not operating properly. If the voltage across power supply 13 is too high, then there is an excellent chance that the igniter 15 is open and no current is flowing through it. Similarly, excessive current through current sensor 18 implies that igniter 15 is shorted, and no current through sensor 18 implies that igniter 15 is open. In each of these situations where the voltage or current is out of the predetermined range, the sensor involved provides a logical 0 output. The symbol "→" means "implies" or "represent", so that the term "1→GOOD" can be read as shorthand for "a logical 1 signal implies that the voltage (or current) sensed is within the predetermined acceptable (good) range".

The AND gate 16 is one of the electronic components receiving its power from power supply 11. If both sensor signals are logical 1 then AND gate 16 provides an igniter signal comprising a logical 1 on path 32. Presence of the igniter signal virtually guarantees that igniter 15 is operating and therefore capable of lighting any combustible fuel mixture surrounding it.

When the igniter signal on path 32 is present, valve driver 22 causes pilot burner valve 21 to open allowing fuel to flow to both flow restricter 25 and main burner valve 27. Fuel flows through restricter 25 to pilot burner 23 where it mixes with air and is ignited by igniter 15 to form a pilot flame. The control voltage on path 14 directly powers both valve 31 as well as main burner valve 27 as shown.

When the pilot flame has been established, a pilot flame sensor 20 within sensing distance of the pilot burner 23 responds by providing a flame present signal to a flame response timer 29. Timer 29 in cooperation with sensor 20 then provides a Boolean 1 flame signal output when flame is present. The flame signal on path 26 thus no longer enables igniter power supply 13 so the power output from supply 13 to igniter 15 ceases. In the preferred design, timer 29 maintains the logical 1 output for a short period of time, perhaps a second or so, even if not sensing presence of a pilot flame, so as to accommodate temporary instabilities in the pilot flame without immediately changing the flame signal. If the pilot flame is not sensed for more than the timer 29 period, then timer 29 changes its output to a logical 0, reenabling the igniter power supply 13. The flame signal on path 26 is also supplied to a valve driver 28 which in turn responds to a logical 1 value of it by causing main burner valve 27 to open. Since valve 31 is open as well, fuel therefore flows to main burner 24. The fuel mixes with air and the pilot flame ignites the main burner 24, thereby completing the ignition sequence.

Whenever the pilot flame is not sensed and the timer 29 period has elapsed, then the logical 0 value for the flame signal causes the main valve to close because driver 28 is no longer enabled. If the igniter 15 is operating properly in response to the logical 0 flame signal value, the pilot valve 31 will remain open, and restarting the pilot and main burners will occur.

Note that if either of igniter current or voltage is not present, the pilot valve 31 will not open. This additional tested condition in this sequence adds further safety in the operation of burners over earlier systems which did not test to assure that pilot ignition was possible. It is possible to sense for only one of the conditions of proper voltage or proper current applied to igniter 15 as the condition for enabling valve driver 22. It is likely that in the vast majority of situations this will be acceptable. The testing of both conditions simply adds a small measure of safety and reliability to burner operation.

It is preferred that igniter 15 be a hot surface igniter. Such an igniter is made from a refractory conductor such as silicon carbide, which has intrinsic resistance allowing it to be electrically heated to perhaps 1000° C. which is sufficient to ignite a suitable fuel mixture. Such a hot surface type of igniter 15 has sufficiently low resistance to cause a measurable drop in power supply 13 voltage from the open circuit value. Voltage sensor 19 preferably provides its Boolean 1 sensor signal when the igniter 15 voltage magnitude reflects ability of the igniter to ignite the pilot burner fuel, and provides a Boolean 0 signal when the igniter is unable to light the pilot. Similarly, current sensor 18 provides a Boolean 1 output when current flow to igniter 15 indicates the present ability of igniter 15 to ignite fuel flowing from pilot burner 23.

It is also possible, though not currently preferred, to use a spark igniter as igniter 15. Since the voltage and current required by a spark igniter is completely different from that of a hot surface igniter, it is likely that completely different types of sensors will be required, although a similar arrangement to sense operation of a spark igniter is possible.

The flow diagram of FIG. 2 shows the sequence of operation for the hardware implementation shown in FIG. 1. It is also possible to incorporate these activities in object code based on this flow diagram which can be used with a microprocessor which receives the sensor or condition signals of the thermostat 12, igniter sensor 18 and flame sensor 20 shown in FIG. 1. The microprocessor also supplies control signals for the operation of valves 21 and 27 and the igniter power supply 13 in FIG. 1. At the present time it is preferred to implement the invention in hardware, but this may well become untrue in the future.

In this flow diagram, the diamond-shaped decision elements represent decision-making microprocessor instruction sequences based on a thermostat or sensor signal. The rectangular boxes are either control elements representing instructions which set the open or closed condition of a valve or turn the igniter power supply 18 on or off or activity elements which change an internal condition of the microprocessor. With the additional capability of a microprocessor, it is possible to have more functions in the control sequence at very little additional cost.

In FIG. 2, an ignition sequence starts with the instructions comprising the decision element 40 which senses whether the thermostat 12 is off or on, and if on, processing passes to the instructions comprising the control element 42. The instructions comprising element 42 cause the microprocessor to issue a signal to the igniter power supply 13 to supply power to the igniter 15. The instructions of element 43 test the igniter signal output of the voltage sensor 18 and if the voltage across power supply 13 indicates the igniter 15 is operating, then operation passes to the instructions of element 45. If the sensor 18 output indicates that igniter 15 is not operating properly, then instruction execution returns to the instructions of element 42.

Once the igniter 15 has been sensed to be operating correctly, then execution of the control element 45 instructions occurs, resulting in the issuing of a pilot valve control signal causing the pilot valve 21 to open. Then the instructions of decision element 49 are executed, which sense the pilot signal output of flame sensor 20 and transfer instruction execution to control element 51 if the pilot signal is present. If the pilot signal is not present, then the instructions of element are continuously executed until the pilot flame is sensed.

Execution of the instructions forming control element 51 cause the microprocessor to issue a control signal to main valve 27 which causes main valve 27 to open. Fuel then flows to the main burner 24 and shortly thereafter, normal operation results in ignition of the main burner flame by the pilot burner flame. The instructions of element 51 also turn the igniter 15 off.

Occasionally, the pilot flame will be extinguished even while the main valve 27 is open. For example, there may be an interruption in the supply of fuel or the pilot flame may be blown out by the rush of main burner fuel without the main burner 24 igniting. If such a condition arises, the pilot signal will vanish. This is potentially a very dangerous situation, with the main and pilot valves open and no flame burning the flowing fuel. This condition is detected by the instructions of elements 54, 55, and 56. After the main valve has been opened by the execution of the instructions of element 51, the function of activity element 54 is performed. These instructions clear an internal memory cell which stores a flame out time value. The instructions of element 55 test the pilot signal to determine whether the pilot flame is present. When the pilot flame is sensed to be out, then operation is transferred to the instructions of activity element 56, which increments the time which the pilot flame is sensed not present. After each instance of this incrementation, the new time value is tested by the instructions of decision element 60 to exceed a pilot sensor response time, and if the flame out time is greater than this response time then execution passes to the instructions of control element 61. If the flame out time is not greater than the response time, then operation transfers back to the element 55 instructions to again test the pilot signal and increment the time if there is no pilot flame.

Control element 61 comprises instructions which cause the microprocessor to issue signals causing the main fuel valve 27 to close and the igniter power source 13 to turn on again. The instructions of element 62 test whether the igniter 15 is receiving power, and if so, passes control to the decision element 49 instructions which, as explained above, test for presence of the pilot flame. If the igniter 15 is sensed to be inoperable, then the microprocessor transfers execution of instructions to those of control element 67 which cause the pilot valve to close. Instruction execution then continues with the instructions of element 43, as symbolized by the connector element A 44, in essence restarting the ignition sequence.

This concludes the description of portions of microprocessor software which deal with ignition and flame safety within the burner of which the elements of FIGS. 1 and 2 form a part. Of course, the microprocessor may have many other safety and operating functions for the furnace as well as these just described.

What I claim is:

1. In a fuel burner having a main burner and a pilot burner for lighting the main burner, an electrically-powered igniter for lighting the pilot burner, a source of electric energy, an igniter power supply receiving a demand signal and supplying power to the igniter responsive to the demand signal, a pilot sensor adjacent to the pilot burner and supplying a pilot signal responsive to presence of a pilot flame, and a main burner valve controlling flow of fuel to the main burner and opening responsive to the pilot signal, an improvement comprising:

(a) a pilot burner valve controlling flow of fuel to the pilot burner and opening responsive to a pilot valve control signal;

(b) igniter sensing means in sensing relation to the igniter for providing an igniter signal responsive to operation of the igniter; and (c) pilot valve control means receiving the igniter signal, for providing the pilot valve control signal responsive to the igniter signal.

2. The apparatus of claim 1, wherein the igniter is a hot surface igniter providing ignition to ambient fuel responsive to flow of electrical energy to the igniter, and wherein the igniter sensing means senses flow of electrical energy to the igniter and provides the igniter signal responsive to a magnitude of electrical energy flow to the igniter within a preselected range.

3. The apparatus of claim 2, wherein the igniter sensing means includes means for providing an igniter signal responsive to voltage across the igniter falling within a predetermined voltage range.

4. The apparatus of claim 2, wherein the igniter sensing means includes means for providing an igniter signal responsive to current flow to the igniter falling within a predetermined current range.

5. The apparatus of claim 2, wherein the igniter sensing means includes means for providing an igniter signal responsive to both voltage across the igniter falling within a predetermined voltage range and current flow to the igniter falling within a predetermined current range.

* * * * *